US010309757B1

(12) United States Patent
Drobockyi et al.

(10) Patent No.: US 10,309,757 B1
(45) Date of Patent: Jun. 4, 2019

(54) AMMUNITION RELOADING APPARATUS

(71) Applicants: Volodymyr Drobockyi, Hebron, CT (US); Anthony Viggiano, Groton, CT (US)

(72) Inventors: Volodymyr Drobockyi, Hebron, CT (US); Anthony Viggiano, Groton, CT (US)

( * ) Notice: Subject to any disclaimer, the term of this patent is extended or adjusted under 35 U.S.C. 154(b) by 0 days.

(21) Appl. No.: 15/653,995

(22) Filed: Jul. 19, 2017

Related U.S. Application Data

(60) Provisional application No. 62/363,941, filed on Jul. 19, 2016.

(51) Int. Cl.
*F42B 33/10* (2006.01)
*F42B 33/02* (2006.01)

(52) U.S. Cl.
CPC ..... *F42B 33/10* (2013.01); *F42B 33/0207* (2013.01)

(58) Field of Classification Search
CPC ..... F42B 33/004; F42B 33/10; F42B 33/005
USPC ..... 86/24, 28, 33, 37, 40, 23
See application file for complete search history.

(56) References Cited

U.S. PATENT DOCUMENTS 3,242,790 A * 3/1966 Bachhuber ..... F42B 33/004 86/25
3,693,497 A * 9/1972 Jacobitz ..... B21D 1/08 86/28
4,188,855 A * 2/1980 Alberts ..... F42B 33/04 86/23
4,329,906 A * 5/1982 Heers ..... F42B 33/04 86/23
4,766,798 A * 8/1988 David ..... F42B 33/004 86/23
4,984,501 A * 1/1991 Roller ..... F42B 33/04 86/23
5,221,806 A * 6/1993 Chaney ..... F42B 33/04 86/19
5,649,465 A * 7/1997 Beebe ..... F42B 33/10 86/1.1
7,395,746 B2 * 7/2008 Bond ..... F42B 33/001 86/24
2004/0025677 A1 * 2/2004 Koch ..... F42B 33/10 86/24
2017/0030690 A1 * 2/2017 Viggiano ..... F42B 5/285

* cited by examiner

*Primary Examiner* — Reginald S Tillman, Jr.
(74) *Attorney, Agent, or Firm* — C. Nessler

(57) ABSTRACT

A device for reshaping casings of spent ammunition cartridges, in one embodiment reduces the diametrical size of the casing wall by forcing the casing into an annular space at the end of a housing through which a plunger shaft slides. In another embodiment, the mouth of a casing is flared outwardly by engagement with the exterior of the end of a housing which has a circumscribing groove to enable easier disengagement of the re-shaped casing. The preferred reshaping devices comprise a plunger having shaft which, when contacted by a casing being re-shaped, compresses an elastomer spring that substantially fills a spring housing cavity and has an exceptionally high spring rate. After each reshaping, the spring causes the plunger shaft to disengage the casing from the device. A recess in the terminal end of a plunger shaft avoids damaging new types of unique two piece casings that have a wave at the interior bottom of the casing.

15 Claims, 4 Drawing Sheets

AMMUNITION RELOADING APPARATUS

This application claims benefit of provisional patent application Ser. No. 62/363,941, filed Jul. 19, 2016.

TECHNICAL FIELD

The present invention relates to devices used to reload casings of ammunition cartridges.

BACKGROUND

A familiar practice for those who use small firearms is to reload a casing after a bullet has been fired, for economy and good environmental practice. This practice is carried out with center-fire cartridges of the kind that are used in a pistol, rifle or other small arms weapon.

To reload a spent casing, the old primer cap is removed and replaced in the base, a new powder charge is placed within the cavity of the casing, and a new bullet is secured in the open end of the casing. However, it may happen that a new bullet will not be as securely held in the casing. This can be attributed to a slight permanent outward deformation of the open end of the casing during firing of a bullet. Thus as taught by the prior art, some remedial shaping is needed.

Manually operated devices for accomplishing such reshaping are variously referred to as, reloaders, presses and dies. Many are described in the patent literature. See for instance, see Heers U.S. Pat. No. 4,329,906, David et al. U.S. Pat. No. 4,766,798, and Bond et al. U.S. Pat. No. 7,395,746. Generally, the devices apply appropriate forces to a casing for reshaping it, and in instances enable installing a new primer cap, powder and a bullet. There are reloading devices which incorporate spring loaded internal parts, such as are shown in these U.S. patents: Alberts U.S. Pat. No. 4,188,855; Roller U.S. Pat. No. 4,984,501; and Beebe U.S. Pat. No. 5,649,465. See also Koch et al. U.S. Patent Publication No. 2004/0025677.

One recent improvement in casing construction is described in U.S. Patent Publication No. 2017/0030690 "Fire arm casing and cartridge." The improved casing is formed of two mated pieces, compared to the traditional one piece brass casing, and the casing has significantly lighter weight and thinner but stronger walls of stainless steel. While the new casings offer a greater number of reloads prior to metal fatigue/failure than do traditional casings, there is a need to avoid damaging such casings inadvertently during the reloading process.

Furthermore, the aforementioned new casings are best made of work-hardened austenitic stainless steel, which is much harder and stiffer than the brass of traditional casings for which the prior art reloading devices have been intended. Substantially more force is required to achieve resizing and flaring, compared to reshaping traditional brass casings of the same ammunition caliber. It has also been found that substantially more force is required to disengage a new type casing from a typical prior art reforming die. For example, where it might take an estimated disengagement force of about 50 pounds to pull a small caliber brass casing off a die, for the new type casing that force may be 100 to 300 pounds for the same die.

The present invention seeks to improve the way in which the reloading process is carried out, with respect to how a casing is re-shaped and to deal with the special problems associated with new kinds of casings.

SUMMARY

An object of the invention is to provide apparatus and method that are useful in connection with reshaping casings for cartridges from which a bullet has been fired so they can be reused. A further object is to provide such kind of apparatus and method that is particularly suited for use with casings that are made of two fastened together pieces, e.g. a base and a stainless steel sleeve. A still further object is to avoid damaging such casings by either separating the pieces, and to avoid damaging the ejector-gripping portions of any kind of casing.

In accord with the invention, one embodiment of device for use in reshaping ammunition so it can be reloaded reduces the diameter of the casing when it is pushed into the annual opening at the end of a housing, within which a spring loaded plunger shaft slides. The plunger shaft is connected to a piston which compresses a unique spring made of elastomer. The spring which is captured within the cavity of a spring housing provides the force needed for the shaft to eject the casing from the end of the housing, particularly for a new type of casings which is made of stainless steel and which presents more re-shaping difficulty than does a traditional brass casing. Preferably, the plunger shaft fits and slides within a bore of a plunger housing along almost its entire length, those allowing the shaft to be of modest diameter without a tendency to bow or buckle.

The new type casings have an exterior shape similar to that of the traditional brass casings for which they substitute. A new type casing comprises a stainless steel sleeve having a nipple which fits a hole in a disk-like base. The nipple end is flared to hold it in place. Certain embodiments of the new type casings have a wave on the bulkhead (which is at the bottom of the cavity of the casing that receives gunpowder). To avoid damage to the wave, the end of a shaft of a reshaping device has a recess or circular groove in the face of the plunger shaft which contacts the interior bottom of the casing and pushes the casing away to disengage it from the housing.

After sizing, to reduce the diameter of the casing mouth, another embodiment of the invention is used to flare the mouth of the casing so it is properly shaped to receive a new bullet. The casing is pressed onto the male end of a housing that is preferably comprises two frusto-conical sections separated by a circumscribing groove.

In further accord with the invention, a device used for flaring may comprise a first portion having an interior cavity with an opening at the proximal end, and a second portion having a bore extending to a bore opening at the distal end of the device which is shaped for flaring of a casing. Thus powder may be dropped into the casing during or after the flaring of the mouth of the casing. The device may be the aforementioned combination of spring housing and plunger housing from which the spring and plunger have been removed.

In further accord with method embodiments of the invention, the foregoing devices are used in combinations. In one mode, the device which effects reshaping to reduce the exterior dimension of the casing is used in a first series of steps, followed by a second series of steps employing the device which flares (and further sizes) the casing. In another method combination, the second series of steps includes depositing gunpowder into the casing.

The foregoing and other objects, features and advantages of the present invention will become more apparent from the following description of preferred embodiments and accompanying drawings.

DESCRIPTION

The disclosure of provisional patent application Ser. No. 62/363,941, filed Jul. 19, 2016, is hereby incorporated by reference.

Figure 1:
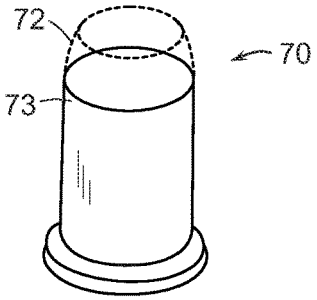
FIG. 1 PRIOR ART
FIG. 1 is a perspective view of a casing for a firearm.
Figure 2:
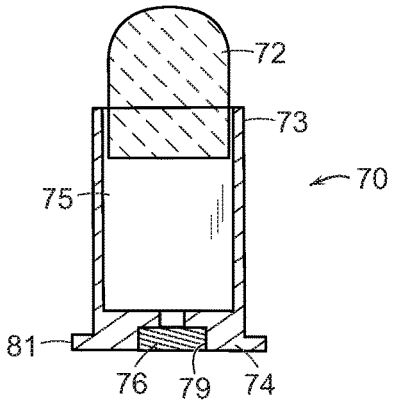
FIG. 2 PRIOR ART
FIG. 2 is a cross section of the casing in FIG. 1.

FIG. 1 is a perspective view and FIG. 2 is a lengthwise cross section of a conventional known type of cartridge comprised of casing 70 and bullet 72, shown in phantom. See FIG. 7 also. Casing 70 comprises base 74, associated flange 81, an internal cavity 75 for receiving gunpowder and a circular wall that extends from the base to open end, or mouth, 73. Primer cap 76 is press fitted within a recess 79 in the base. When ready for use, a bullet 72 is captured at the open end of the casing. Press fitting of the bullet into the open end, sometimes accompanied by inward crimping, holds a bullet in place during handling.

Figure 3:
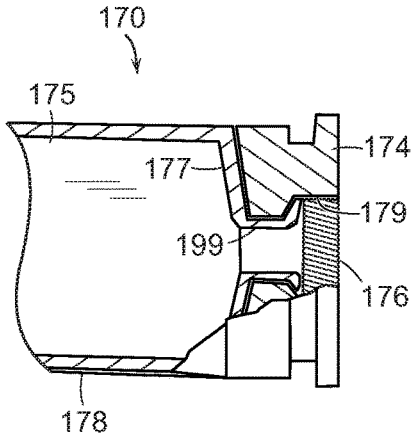
FIG. 3 is a partial cross section of a two-piece casing comprised of a base having a sleeve which is attached by a flared nipple.

FIG. 3 is a partial lengthwise cross section of an improved cartridge having the two-piece construction which is described in patent application Ser. No. 15/221,530, filed Jul. 27, 2016, the disclosure of which is hereby incorporated by reference. The casing is comprised of base 174 and sleeve 178. Base 174 is attached to a sleeve 178 by means of the flared end or lip 179 of sleeve nipple 199 that extends from bulkhead 177. The flared end of the nipple is within a passageway running through the base to a recess at the end of the base, where primer cap 176 is press fitted. The bore of the nipple is also called the flash hole. The foregoing features may be embodied in a casing for a 9 mm caliber firearm cartridge; and that size casing is referred to as an example in connection with the following description. The invention will be useful with a variety of other caliber casings and variations within a caliber. New type casings and old casings intended for the same firearm will have nominally the same exterior dimensions. The present invention is specially configured for use with new type casings but is also useful for traditional one piece brass casings.

While in general it will be accepted that any reloading apparatus should not damage the essential casing, it is important in connection with the aforementioned new design of casing to avoid forces that are of a nature and magnitude sufficient to separate the sleeve from the base. In prior art, and for the new casing, damage to the casing could be caused by the repetitive reworking (reloading), as a result of the casing being pulled from engagement with a reshaping die. An aim of the present invention is to avoid such possible damage.

As suggested in the Background, another factor attending the new casings is that the portion of the casing which is being reworked is made of work hardened stainless steel. For example, an AISI 304 stainless steel used in a casing may have a Rockwell C hardness of about 40, an ultimate tensile strength of about 150,000 pounds per square inch and a modulus of elasticity of about $28\times10^6$ pounds per square inch. Thus to achieve a given strain much more force is required than is required for cartridge brass which may have an elastic modulus of about $16\times10^6$ pounds per square inch. It follows that, compared to cartridge brass, when a stainless steel casing mouth is either compressed in sizing or expanded outwardly during flaring, there will be a higher elastic hoop stress in the casing while it is still engaged with the die, i.e., with the distal end of the plunger housing here. As a result it is much more difficult to disengage a new type casing than an old casing from a die or plunger housing distal end. Features of the present invention aim to both reduce the necessary disengagement force and apply such force in a way which avoids risk of damage.

Figure 5:
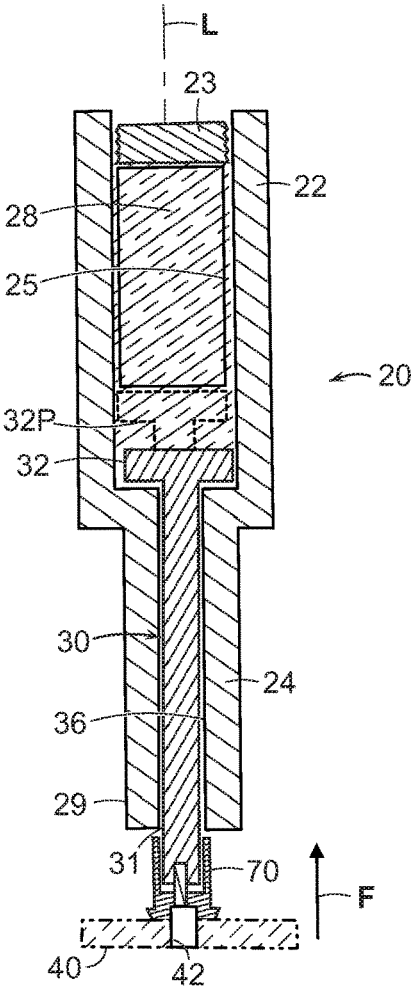
FIG. 5 is a lengthwise cross section of a sizing device along with a casing mounted on a movable platen with which the device is used.
Figure 8:
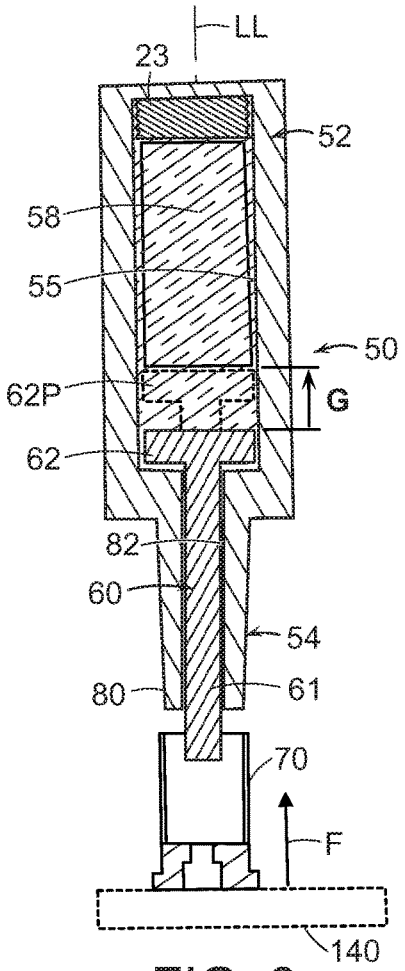
FIG. 8 is a lengthwise cross section of a flaring device along with a casing mounted on a movable platen with which the device is used.

The present invention comprises a sizing device 20 exemplified in FIG. 5 and a flaring device 50 exemplified in FIG. 8. As the description below indicates, the two reshaping devices share common features, but the distal ends (the bottom ends in the Figures here) of the devices are shaped differently. Preferably the devices 20, 50 are used in combination, and sequentially, to prepare a casing for receiving a replacement bullet. They may be used independently.

Embodiments of both sizing device 20 and flaring device 50 may have external shapes that suit them for being used in the types of apparatus (often generally referred to here as "presses") which are well known in the art for reshaping and reloading casings, some of which are referred to in the Background. Devices of the present inventions may be used in alternative configurations of presses, including automated presses.

Figure 4:
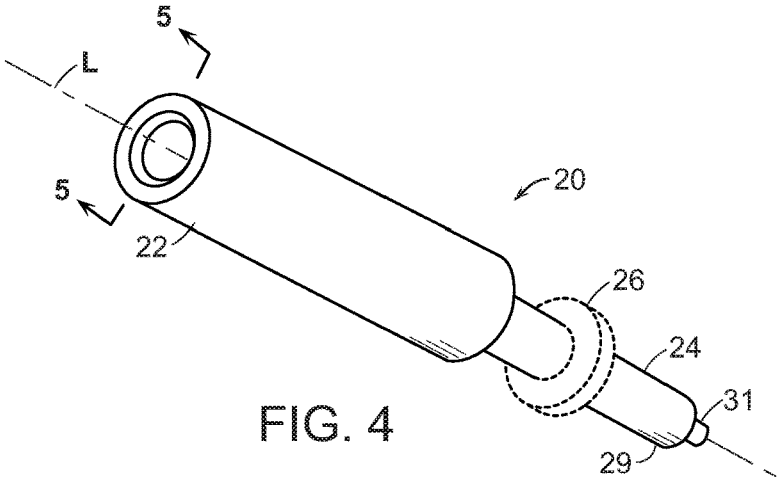
FIG. 4 is a perspective view of the exterior of a sizing device.

FIG. 4 is a perspective view of the exterior of an exemplary reshaping device 20. With reference to FIG. 5 and as further detailed below, the body of device 20 comprises a first portion 22 called the spring housing and a second portion 24 called the plunger housing. The spring housing 22 contains a spring, preferably an elastomer spring 28, and the plunger housing 24 guides shaft 31 of movable plunger 30. Plunger 30 comprises piston 32 which moves axially within the spring housing. Typically, the external surface of the plunger housing is threaded, for installing in a reloading press. Optional ring 26, shown in phantom, circumscribes the cylindrical outside surface of the plunger housing to facilitate the mounting of the device 20 in a common kind of commercial press. The spring housing and plunger housing are preferably integral portions of the device 20 but may be separate, fastened-together parts.

In typical use, a device 20 is mounted fixedly in a press in opposition to a platen 40 and the device and platen move toward and away from each other along the device longitudinal axis L. Neither the press which holds the body of a device 20 nor the press structure and actuators which guide and move a platen and device relative to one another, to engage the casing with the device, are shown; they are well known to artisans. For simplicity of illustration here, only the movable platen 40 is shown (mostly in phantom). The term "platen" refers to any mechanism which supports the base of a casing for engagement and disengagement with a device 20.

Some of the clearances between the different parts of the devices and workpieces (casings) shown in the cross sections of the Figures here are exaggerated for purposes of clarity of illustration. The structural parts of devices of the present invention are preferably constructed of steel with the wear-portions, optionally the whole of the housings, having a high hardness to resist wear.

Figure 6:
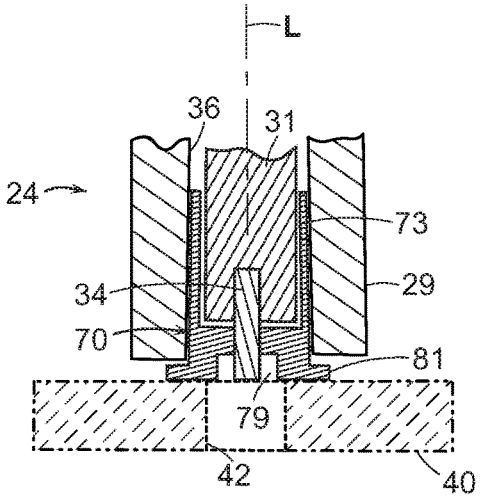
FIG. 6 is a partial lengthwise cross section of the sizing device shown in FIG. 5 after the platen has risen upwardly and pushed the casing onto the end of the sizing device, to reduce the outside dimension of the casing.

The configuration and use of the sizing device 20 will now be described. FIG. 5 is a lengthwise (vertical) center plane cross section of sizing device 20 in combination with a casing. FIG. 6 is a partial view of the lower end of device 20, where the platen 40 has been moved vertically toward the device, as indicated by arrow F in FIG. 5, so casing 70 engages housing distal end 29.

The purpose of device 20 is to reduce the diameter of the mouth, or circular open end, 73 of the casing inasmuch as the prior firing of a bullet has left it expanded. In the process carried out by device 20, the open mouth end 73 of the casing is pressed into the bore 36 of the distal end 29 of the plunger housing 24. Bore 36 has a bottom end opening that is sufficiently large to receive the end 73 of the casing in its expanded or "slightly-too-large" condition. Bore 36 has tapers inwardly with distance from the terminal end of the housing at the distal end of the device. The taper is sufficient to reduce the outside diameter of the casing to the dimension suited for the bullet to be used in reloading the casing. That portion of a device which contacts the casing to deform it may be referred to as a die.

The invention may also be used to re-shape the part of a casing which is nearer the flange 81, when that region has been bulged outwardly during the prior use. Sizing with the device 20 aims to force the casing back to near its original dimension, so it will fit into the chamber of a gun.

Plunger 30 of device 20 has a piston end 32 that slides resiliently within the bore 25 of spring housing 22. Preferably, there is a close fit between the periphery of the piston and the interior wall of the bore 25, but a lesser fit may be employed in view of the sliding engagement of the shaft with the plunger housing. Plunger 30 moves lengthwise (vertically in the Figures) along central axis L of the device when force is applied to the terminal end of plunger shaft 31, which projects from the bottom end of the device 20 when the device is in its rest configuration. Preferably, as shown, the shaft is supported along its length by means of its good sliding fit within the whole length of bore 36, excluding the end where there is an annular space, thus allowing the shaft to be of modest diameter without bending or buckling under the high spring force. The cavity of spring housing 22 is closed by threaded plug 23 at the proximal end of the device, so the elastomer body which is spring 28 is captured. The spring and piston are removable from the device by removing plug 23. Other closures than a plug threaded into a bore hole may be used, sufficient to provide support for the spring and keep the spring in place within the cavity. Alternatively, when the housings 22, 24 are separate interconnected pieces the closure of the cavity at the proximal end of the housing 22 may be an integral wall.

During use, the platen bearing a casing 70 moves toward the distal end of the housing (i.e., it rises upwardly in the Figure). When shaft 31 is contacted by the casing, piston 32 of plunger 30 is caused to move slidably within the bore 25 of the spring housing, to compress the spring 28, as indicated by the phantom 32P of the piston end of the plunger in FIG. 5. Preferred spring 28 is a cylindrical piece of elastomer rod that has a small radial clearance with the bore 25 of the spring housing. For example, the radial clearance may be about 0.040 inch when the spring has a diameter of about 0.5 to 0.75 inch. The piston is shaped to have an area which contacts substantially all of the end of the spring. When the plunger of the device is in the rest position, the combination of spring 28 and piston 62 substantially fill the interior cavity of the spring housing which is defined by the wall of the bore 25, the interior surface of plug 23 and the shoulder against which the shaft-side of the piston reposes (excluding the bore 36 and whatever recesses or the like that might be present in the shoulder for other purpose). Such confinement of the elastomer spring and engagement by the piston mean that exceedingly high forces can be generated with small displacement of the plunger shaft.

Preferably spring 28 is made of an elastomer such as polyurethane having a Shore A Durometer Number of 85-100, more preferably Shore A 95. Other compressible resilient substances may be used in substitution of the preferred material. In an exemplary device 20 which is useful with a 9 mm cartridge casing and which has the just-mentioned more preferred spring material. Spring 28 may be about 0.5 inch in diameter and about 1.6 inch in length; and it can exert a force of about 300 pounds when the piston compresses the spring about 0.3 inch. The spring rate (ratio of force to displacement) is about 1,000 pounds per inch. Having such a high spring force for such a short stroke in a compact 0.5 inch diameter size is peculiarly characteristic of the particular-material elastomer spring material described above. Preferably the spring rate is between 800 and 1,500 pounds per inch in embodiments of the invention. That the spring is wholly contacted by the piston and that the spring substantially fills the spring housing cavity contribute to the effectiveness of the invention.

FIG. 5 and FIG. 6 show how, during use of the device 20, the casing is placed on platen 40 (shown in phantom); and the platen moves vertically along axis L, as indicated by arrow F. During that motion, end 73 of the casing enters the opening of bore 36 of the distal/exit end of the plunger housing of device 20. The mouth of the casing is received in the annular space between the bore and the shaft 31. FIG. 6 shows the platen in raised up position, so that the flange of the casing may contact the distal end 29 of the plunger housing, and so that most of the length of the body of the casing is inserted into the annular space at the end of bore 36. During that motion, the plunger piston 32 is moved vertically, thereby compressing spring 28 and storing energy in the spring.

The dimension of the bore 36 at the distal end of the plunger housing is chosen to be that which (taking into account any spring back of the metal of the casing), will restore by compression and permanent deformation the diameter of the mouth end of the casing. In a typical resizing of a 9 mm casing, the outside diameter of the open end of the casing might be reduced by about 0.002 to 0.005 inches along about 0.4 to 0.6 inches of axial length from the mouth end opening. The die region of the bore near the opening, which defines the annular space, is subject to wear from shaping many casings, and therefore a carbide bearing insert (or die) may be incorporated in the distal end of device 20.

Shaft 31 preferably has a terminal end (which may be stepped) that has a loose fit within the bore of a casing, sufficient to center the casing on the shaft while allowing the casing to fall from engagement with the shaft when the platen is removed. For example, there may be about 0.010 inch radial clearance.

Preferably the terminal end of shaft 31 comprises a pin 34 which projects axially from the terminal end of the shaft. As can be envisioned from FIG. 6, when the casing has reached its full extent of insertion into the bore 36 of device 20, pin 34 passes through the flash hole and enters recess 79 of the base, thereby to push the spent primer 76 from its pressed-in position within the recess. The primer (not shown in FIG. 6) has fallen through hole 42 in the platen 40. Preferably, pin 34 is an AISI 420 stainless steel coiled roll pin of about $1/16^{th}$ inch diameter; it provides an advantage in tolerating bending loads on the pin.

When the platen is moved away from the device 20, the stored energy in the spring provides a force which pushes the plunger piston downwardly, so the shaft 31 moves downwardly in the Figure. That causes the casing to be thrust out of the bore of the plunger housing. Since the end of the plunger has by design a loose fit within the cavity of the casing, the casing can then fall downwardly away from the plunger, onto or around the platen, ultimately to a bin or other receiving means for further processing. Advantageously, the invention enables engagement with a casing which is not gripped to the platen.

Figure 6B:
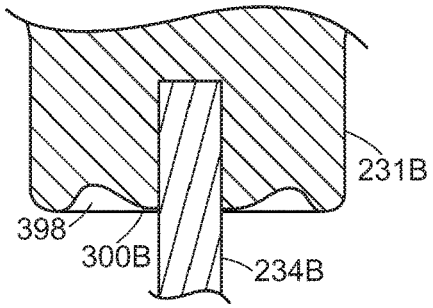
FIG. 6B is a partial lengthwise cross section of a plunger shaft which is an alternative to that shown in FIG. 6A.
Figure 6A:
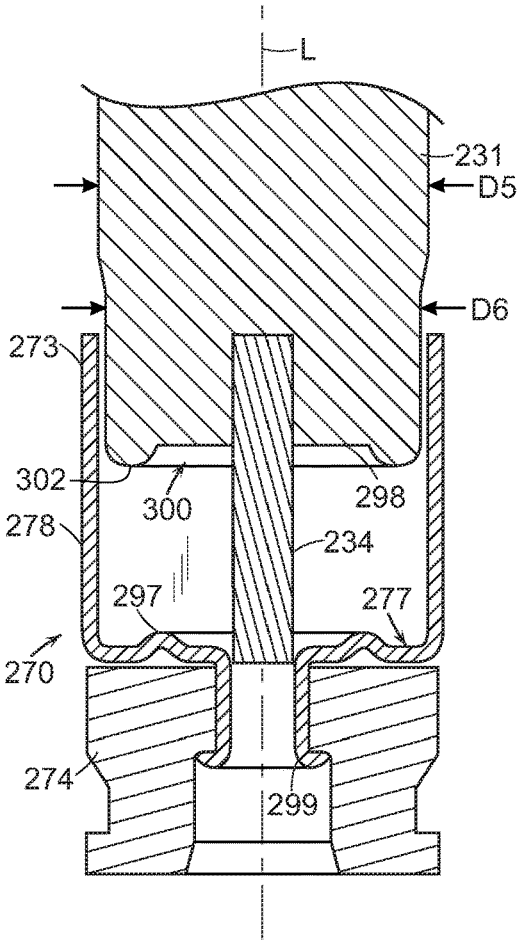
FIG. 6A is a lengthwise cross section view of a plunger shaft embodiment entering a casing, similar in kind to the view of FIG. 6.

FIG. 6A shows the distal end of a plunger shaft 131 which is particularly suited for sizing a casing that is similar to the casing 170 shown in FIG. 3, and other casing embodiments described in the aforementioned application Ser. No. 15/221,530. Casing 270 comprises a sleeve 278 that is attached to a base 274 by means of nipple 299 which extends lengthwise from bulkhead 277. The bulkhead comprises a wave 297, which is a circumscribing ridge or raised up bulkhead portion that is found beneficial in having thin but strong sleeves. Shaft 231, from which projects pin 234, is shown as the shaft moves within the mouth of the casing, at the point where the pin is entering the flash hole or bore of the nipple of the casing sleeve. The face 300 of the distal end of the plunger shaft has a recess 298 so that when the shaft contacts the bulkhead 277, only the outer raised up rim 302 contacts the bulkhead and so that the wave feature is not contacted and potentially distorted.

FIG. 6B is a partial view like that of FIG. 6A, showing an alternative embodiment plunger shaft 231B, from which projects pin 234B. The face 300B of the shaft has a depression in the form of circular groove 398, which is shaped to receive a casing having a bulkhead 277 with a wave 297. Plunger shafts with distal end faces having the foregoing recesses may also be used with device 50.

FIG. 6A also illustrates a preferred external configuration of the plunger shaft which may be used in other shaft embodiments as well. The outside cylindrical surface of the shaft at the distal end of the shaft has a nose circumferential edge which is rounded or heavily chamfered. A first axial portion of the exterior has a diameter D6 which is sufficiently small to enable easy entry of the shaft into the casing interior. That portion transitions to a larger diameter D5 which is smaller, but close to the inside diameter of the mouth 273 of the casing. During the sizing step, there is frictional engagement of the casing with the bore of the annular space at the distal end of the plunger housing and not with the plunger shaft.

After sizing by means of device 20, the next step typically includes flaring of the outer extremity of the casing mouth to facilitate insertion of a bullet. Flaring may be carried out by device 50, the construction and use of which will now be described.

Figure 7:
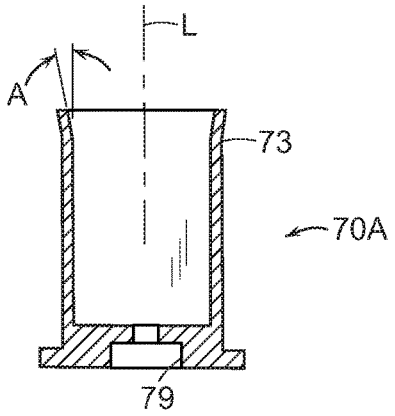
FIG. 7 is a lengthwise cross section of a casing with a flared end.

FIG. 7 shows a cross section of casing 70A which has been flared at end 73, also called the mouth. The extent of the flare is exaggerated for purpose of illustration. A casing is flared outwardly to an angle A which is preferably about 10 to 30 degrees. The dimension of the bore of the casing which is proximate the flare may be simultaneously increased to reverse a too-small dimension as a result of the prior sizing operation. In an example of the use of device 50, when a 9 mm bullet suited for a casing has a diameter of about 0.355-0.356 inches, the interior of the outermost part of the flared portion of a casing may have a diameter of 0.358 to 0.365 inches; and the inner portion of the casing adjacent the flare, where a bullet will be gripped, may have a diameter of about 0.353 inches.

Figure 9:
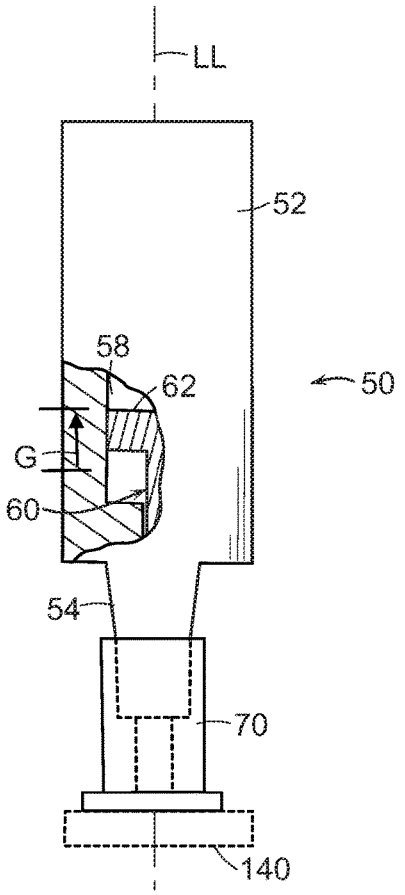
FIG. 9 is a side view of the flaring device shown in FIG. 8 with a partial cross section, after the platen has risen upwardly and pushed the casing onto the end of the flaring device.

FIG. 8 is a lengthwise center plane cross section of exemplary flaring device 50 in its rest configuration, ready to engage casing 70 for flaring. FIG. 9 is side view of device 50, with a partial cross section, showing device 50 after the casing has been thrust upwardly by movement of platen 140 along axis LL, as indicated by arrow F in FIG. 8, thus compressing the spring.

An embodiment of device 50 preferably has spring housing, spring and plunger construction that is like that described for device 20, for the same advantageous reasons as have been described. In particular, flaring device 50 comprises a spring housing 52, plunger housing 54, spring 58, and plunger 60. Plunger 60 comprises piston 62 which slides within bore 55 and shaft 61 which slides within the bore 82. The functions of the components are essentially similar to what is described in connection with device 20, except for the distal end of plunger housing 54. That distal end comprises nose 80 that is shaped for being forced within the mouth 73 of the casing 70 to flare it outwardly. As mentioned, the distal end that deforms the casing may be referred to as the die.

During operation of device 50, the upward movement F of platen 140 causes casing 70 to contact the distal end of plunger shaft 61; that thrusts the shaft upwardly within its housing. That in turn causes plunger piston 62 to move along bore 55 of the spring housing and compress spring 58, as indicated by the arrow G and phantom 62P in FIG. 8.

In one embodiment, the outside surface of the distal end of plunger housing 54 is slightly conical in shape, transitioning from a first diameter nose 80 which preferably is shaped to effect resizing of the bore of the casing, to a larger diameter portion that effects flaring, as detailed further below. After the casing 70 is pushed sufficiently onto the housing of device 50 to permanently deform the casing, the platen is separated from the housing. Then, the stored energy in the spring pushes the plunger downwardly, causing the plunger shaft to push the casing off of the distal end of the plunger housing. Since the fit of the plunger shaft within the bore of the casing is loose, when the casing is removed from engagement with the housing, the casing can fall downwardly onto or around the platen and ultimately to a bin or other receiving means for further processing, i.e., for installation of a new primer, gunpowder, and a bullet using other devices. Because the exterior of the distal end of the plunger housing, or die portion, is subject to wear, that portion of the housing, or the whole of the two integral housings, can be made of hardened steel.

Figure 10:
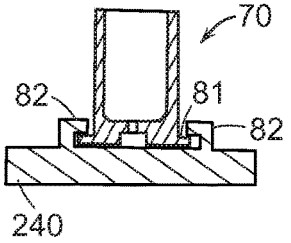
FIG. 10 is a vertical cross section view of a casing held by grips on a platen.

FIG. 10 is a vertical cross section of a platen supporting a casing, showing an alternative embodiment of platen 240 which can be used in combination with devices 20, 50. The platen has lips 82, which in top view could be spaced apart fingers or half-circumferential pieces that hold the flange 81 against the surface of the platen 240. Analogous structure may hold the cannelure on the platen when a casing has such feature. Lowering of platen 240 works in combination with the force applied by the plunger shaft, to disengage a casing the plunger housing. As noted, platen grips will not be needed when the plunger shaft exerts sufficient force.

Figure 11:
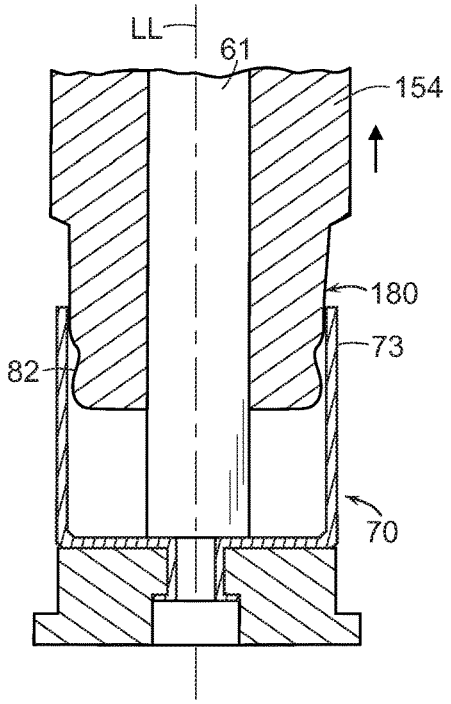
FIG. 11 is a cross section view of the nose of a portion of plunger housing as it engages a casing to effect flaring.
Figure 12:
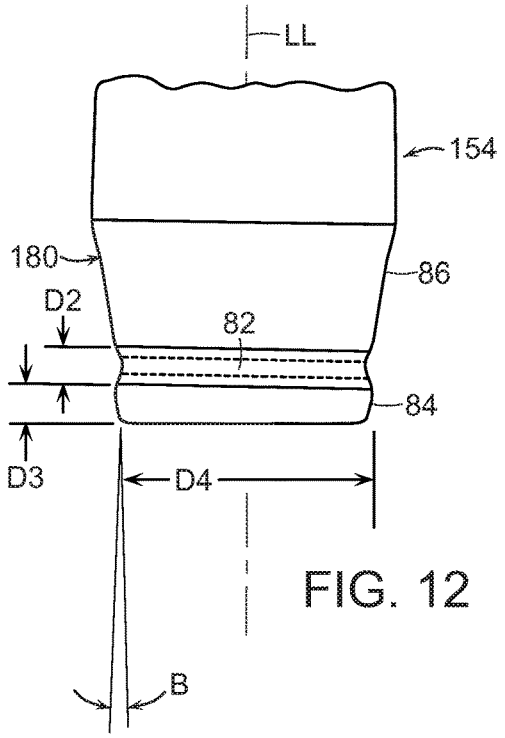
FIG. 12 is a side view of the plunger housing shown in FIG. 11, illustrating the compound angle exterior contour and circular groove.

The distal end of the plunger housing of the flaring device 50 may have a rounded end and straight (cylindrical) circumscribing shape that extends to a taper portion which causes the flaring, as in prior art devices. Preferably, the distal end of the housing is shaped in a better way, which lessens the force needed to get the casing off the housing, after flaring. FIG. 11 is a cross section of the distal end of plunger housing 154, where the housing is engaged with casing 70, ready for withdrawal by upward relative movement of the housing, as indicated by the arrow. The distal end of the plunger shaft 61 is shown as it pushes on the interior bottom of the casing. With reference also to the side view of the housing in FIG. 12, housing 154 comprises two frusto-conical sections separated lengthwise by a circumscribing shallow groove 82. The terminal end of nose 180 has a rounded outer edge or rim, and a diameter that enables easy entry into the mouth of casing 70 before it is flared. Preferably, first lengthwise frusto-conical section 84 of the nose—that which is nearest the tip or terminal end of the nose 180—has a nominal angle of about 0.25 to 5 degrees, preferably about 0.5 degrees, all relative to the lengthwise axis LL. And there is a second lengthwise frusto-conical section 86 which has a preferred angle of about 10 degrees to axis LL (so, the included angle is about 20 degrees). Between the two frusto-conical section is groove 82. In alternative embodiments of the invention, there may be more than one groove.

In an exemplary nose suitable for a 9 mm casing, a groove will be about 0.005 inch deep and have a width D2 of about 0.06 inch. The groove edge will be a distance D3 of about 0.08 inch from the tip of the nose. In a casing which has been flared, the flared portion will extend about 0.020 to 0.030 inches lengthwise from the mouth edge (compared to an overall casing length of about 0.75 inches). To achieve that flare and resizing of the casing bore, the operative die portion of a preferred housing 154 will enter to a depth of about 0.2 to 0.3 inches.

The first section 84 starts the flaring process, and ensures the casing will be centered. And when the plunger housing is fully inserted in the casing, the first section 84 expands the dimension of the casing bore that is adjacent the flare region and nearer to the bottom of the casing, as needed to get the right fit for a bullet. Thus when the housing is fully inserted there is elastic hoop force in the casing at both sections 84, 86. And that creates frictional force that must be overcome by the force of spring powered shaft 61, in order to eject the casing from the housing when the platen is moved away from the housing.

With reference to the above dimensions for an exemplary situation, when a housing is fully engaged with a casing, and ready for withdrawal, the presence of the groove will reduce by about 30 percent that portion of the length of the nose which is in hoop-stretching engagement with the housing. The force needed to separate a casing from the housing is substantially reduced by presence of a groove.

Figure 13:
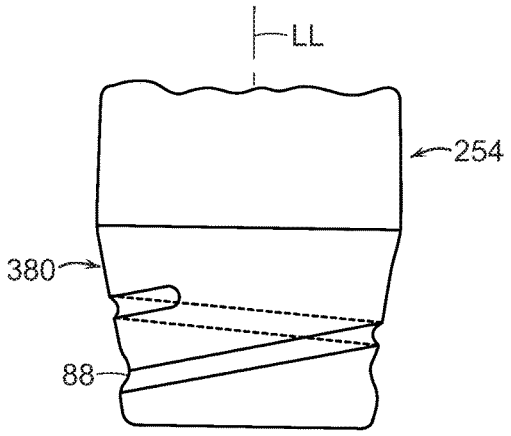
FIG. 13 is a view like FIG. 12, showing an alternative plunger housing having a spiral groove.

FIG. 13 shows a variation on the foregoing, namely a housing nose embodiment 380 that is a portion of plunger housing 254. Spiral groove 88 of at least one full turn runs around the first section. Groove 88 preferably has width and depth dimensions in accord with groove 82.

Figure 14:
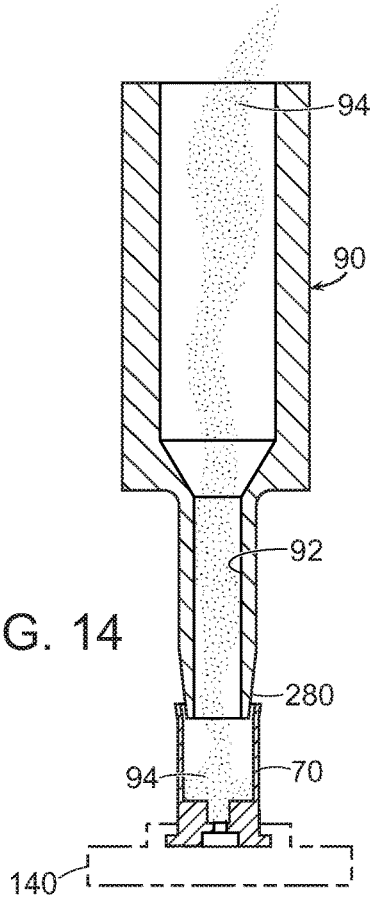
FIG. 14 is a lengthwise cross section of a tool having a distal end like the housing of FIG. 12.

The foregoing plunger housings 154, 254 are useful in connection with a plunger having a shaft that is spring loaded, as shown in FIG. 8. Alternatively, housings having the specially shaped and groove-containing nose are found to lower the case-extraction force sufficiently to enable casings t be reshaped by devices which grip a casing on the platen and lack a spring loaded plunger. As an example, FIG. 14 is a cross section of the tool 90, which has an exterior shape like device 50. As will be visually apparent, tool 90 may be in fact the housing comprised of portions 52, 54, as shown in FIG. 8, after the plug, spring and plunger have been removed from the proximal end of the device 50.

In alternative embodiments of tool 90 there may be a constant external diameter and or a constant diameter bore 92. Tool 90 has a nose 280 like a preferred nose 180 of housing 154. In the use of tool 90, the casing 70 (shown with a primer cap in place) is clamped to a platen 140 shown in phantom. After the platen or tool is moved so that the nose enters the casing mouth and causes flaring, the platen moves away from tool 90, to pull the casing from the nose. In FIG. 14, the casing is shown as it being almost entirely disengaged from the tool. At that point gunpowder 94 may be deposited in the bore 92 of the tool, so it drops into the inside of the casing, as illustrated. Tool 90 thus might alternatively be configured as, and referred to, as a flaring funnel. Tool 90 may be used in prior art reloading apparatus where gunpowder is put into the casing at the same reloading station at which flaring is accomplished.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A device having a length axis, a proximal end, and a distal end, for reshaping a casing having a substantially cylindrical open-end portion a flash hole, and a wall, to prepare the casing for reuse, comprising:

a spring housing having an interior cavity, a first end which is the proximal end of the device, and a second end;

a plunger housing, having a first end connected to the second end of the spring housing, a second end which is the distal end of the device, and a bore running lengthwise from a bore opening at the second end of the plunger housing to said cavity of the spring housing;

a plunger comprising a piston slidably positioned for lengthwise movement within said interior cavity of the spring housing and a shaft connected to the piston, the shaft having a substantially smaller diameter than the piston, slidably positioned for lengthwise movement within the bore of the plunger housing and extending to a shaft terminal end at the distal end of the device, the plunger having a rest position wherein the terminal end of the shaft projects outwardly from said bore opening;

a spring, contained within the interior cavity of the spring housing and in contact with the piston, for urging the plunger toward the distal end of the device; and, a pin, substantially smaller in diameter than the terminal end of the plunger shaft, extending lengthwise therefrom, for fitting within the flash hole of the casing;

wherein the portion of said plunger housing bore which is near said bore opening decreases in diameter with distance from said bore opening and is spaced apart from the plunger shaft, thereby providing an annular space for receiving said open-end portion of the casing and for pressing radially inwardly the wall of the casing; and, wherein the terminal end of the plunger shaft comprises a face for pressing on the interior of the casing, the face having a recess circumscribing said pin.

2. The device of claim 1 wherein the recess is a circular groove.

3. The device of claim 1 in combination with said casing, wherein the casing is comprised of a base and a sleeve having a bore and a mouth which comprises said open end portion of the casing, wherein the sleeve is attached to the base by means of a nipple extending from a bulkhead into the casing base, wherein the bulkhead comprises a wave, and wherein the recess in the face of the terminal end of the plunger shaft fits the wave.

4. The device of claim 1 wherein the spring is made of an elastomer, has a spring rate of from 800 to 1,500 pounds per inch, and wherein the spring with said piston substantially fills the interior cavity of the spring housing when the plunger is at said rest position.

5. A device having a length axis, a proximal end, and a distal end, for reshaping the substantially cylindrical open-end portion of a casing to prepare the casing for reuse, comprising:

a spring housing having an interior cavity, a first end which is the proximal end of the device, and a second end;

a plunger housing, having a first end connected to the second end of the spring housing, a second end which is the distal end of the device, and a bore running lengthwise from a bore opening at the second end of the plunger housing to said interior cavity of the spring housing;

a plunger comprising a piston slidably positioned for lengthwise movement within said interior cavity of the spring housing and a shaft connected to the piston, the shaft having a substantially smaller diameter than the piston and slidably positioned for lengthwise movement within the bore of the plunger housing, the shaft extending lengthwise to a shaft terminal end at the distal end of the device, the plunger having a rest position wherein the terminal end of the shaft projects outwardly from said bore opening; and, a spring, contained within the interior cavity of the spring housing and in contact with the piston, for urging the plunger toward the distal end of the device;

wherein said plunger housing second end is shaped for fitting into said open-end portion of the casing and comprises a frusto-conical exterior that increases in diameter with distance from said bore opening; and, wherein at least one groove circumscribes said exterior of the plunger housing.

6. The device of claim 5 wherein the plunger housing exterior comprises a first frusto-conical section, having a first angle with respect to said device length axis, proximate the second end of the plunger housing, and a second frusto-conical section, having a second angle with respect to said device length axis which is greater than said first angle, the second frusto-conical section farther from said second end and larger in transverse dimension than is the first frusto-conical section; and, wherein the least one groove is located between the two frusto-conical sections.

7. The device of claim 5 wherein the groove runs on a spiral path.

8. The device of claim 5 wherein the spring is made of elastomer and, with said piston, substantially fills the interior cavity of the spring housing when the plunger is at a rest position and wherein the spring has a spring rate of from 800 to 1,500 pounds per inch.

9. The device of claim 5 where the plunger shaft terminal end comprises a face for pressing on the interior of the casing, the face having a recess in the shape of a circular groove.

10. The device of claim 5 wherein the spring and piston are removable from the proximal end of the device, thereby leaving the interior cavity open at the proximal end, to thereby provide a passageway comprising said interior cavity and said interconnected plunger housing bore adapted for flowing gunpowder into a casing which has been positioned at the distal end of the device for flaring.

11. A device having a proximal end and a distal end and a length axis, adapted for flaring the mouth of a casing and for depositing gunpowder into the casing after flaring which comprises:

a first portion having an interior cavity with an opening at said proximal end; and, a second portion having a lengthwise bore connected to said interior cavity, the bore extending to a bore opening at said distal end;

wherein said second portion comprises a frusto-conical exterior that increases in diameter with distance from said bore opening at the distal end; and, wherein at least one groove circumscribes the exterior of the second portion.

12. The device of claim 11 wherein the exterior of the second portion comprises a first frusto-conical section proximate the bore opening and a second frusto-conical section which is farther from the bore opening and larger in dimension than the first frusto-conical section; wherein the least one groove is located between the two frusto-conical sections.

13. A method of reshaping a casing for ammunition, the casing having an open-end portion, a wall, and a base, which comprises:

(a) providing a first device of claim 1 having a length axis, a proximal end, and a distal end, for reshaping a casing having a substantially cylindrical open-end portion a flash hole, and a wall, to prepare the casing for reuse, comprising:

a spring housing having an interior cavity, a first end which is the proximal end of the device, and a second end; a plunger housing, having a first end connected to the second end of the spring housing, a second end which is the distal end of the device, and a bore running lengthwise from a bore opening at the second end of the plunger housing to said cavity of the spring housing; a plunger comprising a piston slidably positioned for lengthwise movement within said interior cavity of the spring housing and a shaft connected to the piston, the shaft having a substantially smaller diameter than the piston, slidably positioned for lengthwise movement within the bore of the plunger housing and extending to a shaft terminal end at the distal end of the device, the plunger having a rest position wherein the terminal end of the shaft projects outwardly from said bore opening; a spring, contained within the interior cavity of the spring housing and in contact with the piston, for urging the plunger toward the distal end of the device; and, a pin, substantially smaller in diameter than the terminal end of the plunger shaft, extending lengthwise therefrom, for fitting within the flash hole of the casing; wherein the portion of said plunger housing bore which is near said bore opening decreases in diameter with distance from said bore opening and is spaced apart from the plunger shaft, thereby providing an annular space for receiving said open-end portion of the casing and for pressing radially inwardly the wall of the casing; and, wherein the terminal end of the plunger shaft comprises a face for pressing on the interior of the casing, the face having a recess4*n*-the circumscribing said pin;

(b) engaging the open end portion of the casing with the distal end of said first the claim 1 device by applying lengthwise force sufficient to cause the distal end of the plunger housing to enter the open end portion of the casing, thereby to deform the open end portion radially inwardly and to move the plunger from the plunger rest position, thereby moving the terminal end of the shaft lengthwise and causing the piston to compress the spring;

(c) releasing said lengthwise force, and allowing the spring to resiliently return the plunger to the plunger rest position, wherein the terminal end of the plunger shaft moves outwardly from the distal end of the plunger housing, so the casing is pushed from engagement with the distal end of the plunger housing;

(d) providing a second device of claim 5;

(e) engaging the open-end portion of the casing as deformed by carrying out step (b) with the distal end of the second claim 5 device by applying lengthwise force sufficient to cause the distal end of to enter the open-end portion of the casing, thereby to deform the mouth radially outwardly;

(f) releasing said lengthwise force, and disengaging the casing from the distal end of the claim 5 second device.

14. The method of claim 13 which further comprises:

(g) removing the spring and plunger from the second device and depositing gunpowder into the interior cavity at the proximal end of the first portion of the second device, so the gunpowder flows through said interior cavity of the second device and through said bore of the second portion of the second device, and then into the casing, before or after step (f).

15. The device of claim 11 wherein the at least one groove runs on a spiral path.

* * * * *